US010535929B2

(12) United States Patent
Ju et al.

(10) Patent No.: US 10,535,929 B2
(45) Date of Patent: Jan. 14, 2020

(54) CONNECTOR WHICH CAN BE STABLY PLACED ON A CIRCUIT BOARD

(71) Applicant: LOTES CO., LTD, Keelung (TW)

(72) Inventors: Ted Ju, Keelung (TW); You Hua Cai, Keelung (TW)

(73) Assignee: LOTES CO., LTD, Keelung (TW)

( * ) Notice: Subject to any disclaimer, the term of this patent is extended or adjusted under 35 U.S.C. 154(b) by 239 days.

(21) Appl. No.: 15/867,952

(22) Filed: Jan. 11, 2018

(65) Prior Publication Data

US 2019/0067838 A1 Feb. 28, 2019

(30) Foreign Application Priority Data

Aug. 28, 2017 (CN) ..... 2017 1 0748769

(51) Int. Cl.

| | |
|---|---|
| ***H01R 4/02*** | (2006.01) |
| ***H01R 13/629*** | (2006.01) |
| ***H01R 12/72*** | (2011.01) |
| ***H01R 12/71*** | (2011.01) |
| ***H01R 12/73*** | (2011.01) |
| ***H01R 12/57*** | (2011.01) |

(52) U.S. Cl.

CPC ..... *H01R 4/027* (2013.01); *H01R 12/716* (2013.01); *H01R 12/721* (2013.01); *H01R 13/62938* (2013.01); *H01R 12/57* (2013.01); *H01R 12/737* (2013.01)

(58) Field of Classification Search

CPC .. H01R 12/721; H01R 12/725; H01R 12/714; H01R 12/716; H01R 4/027; H01R 13/62938; H01R 12/737; H01R 12/57; H05K 1/181; H05K 3/341; H05K 2201/10439; H05K 2201/10454

USPC ..... 439/60, 62, 80; 174/260

See application file for complete search history.

(56) References Cited

U.S. PATENT DOCUMENTS 6,135,781 A * 10/2000 Pope ..... H01R 12/716 439/59
6,152,742 A 11/2000 Cohen et al.
7,413,451 B2 8/2008 Jeon
(Continued)

FOREIGN PATENT DOCUMENTS

CN 2674678 Y 1/2005
CN 102210063 A 10/2011
CN 103390811 A 11/2013

*Primary Examiner* — Amy Cohen Johnson
*Assistant Examiner* — Paul D Baillargeon
(74) *Attorney, Agent, or Firm* — Locke Lord LLP; Tim Tingkang Xia, Esq.

(57) ABSTRACT

A connector includes: an insulating body having a bottom surface facing a circuit board; and multiple first terminals and multiple second terminals. Each of the first and second terminals has a fixing portion fixed to the insulating body and a soldering portion bending and extending from the corresponding fixing portion and exposed out of the bottom surface of the insulating body. The first and second soldering portions are soldered to the circuit board in a surface mounting manner respectively, and are arranged in four rows in a transverse direction. The first soldering portions are distributed in two outer rows. The second soldering portions are distributed in two inner rows. A bottom surface of each first soldering portion has a lowest point. The lowest points of the first soldering portions in the two outer rows define a plane, and the second soldering portions are located above the plane.

18 Claims, 12 Drawing Sheets

(56) References Cited

U.S. PATENT DOCUMENTS

| | | | | |
|---|---|---|---|---|
| 9,392,702 | B2 | 7/2016 | Okuyama et al. | |
| 2005/0142907 | A1 * | 6/2005 | Myer ..... | H01R 12/712<br>439/79 |

* cited by examiner

A-A

CONNECTOR WHICH CAN BE STABLY PLACED ON A CIRCUIT BOARD

CROSS-REFERENCE TO RELATED PATENT APPLICATION

This application claims priority to and the benefit of, pursuant to 35 U.S.C. § 119(a), patent application Serial No. CN201710748769.5 filed in China on Aug. 28, 2017. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to a connector, and more particularly to a connector for inserting an electronic card.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A conventional connector is used for being mounted on a circuit board. The connector includes an insulating body and multiple terminals assembled on the insulating body. A bottom surface of the insulating body faces the circuit board. Each terminal has a fixing portion fixed to the insulating body and a soldering portion exposed out of the bottom surface of the insulating body. The soldering portions of the terminals are arranged in four rows, and the soldering portions include multiple first soldering portions and multiple second soldering portions. The first soldering portions are distributed in the two outer rows, and the second soldering portions are distributed in the two inner rows.

According to the connector soldered to the circuit board in a surface mounting manner, the terminals may have manufacturing tolerances, and the first soldering portions and the second soldering portions may have assembly tolerances after the terminals are assembled on the insulating body. Thus, lowest points of the first soldering portions and lowest points of the second soldering portions may be uneven. However, when the second soldering portions in the inner rows are lower than the first soldering portions in the outer rows, and the connector is placed on the circuit board, the second soldering portions abut the circuit board first, so that the second soldering portions in the two inner rows function as supporting points when the connector is positioned on the circuit board. In particular, the connector has an elongated structure, the soldering portions are arranged in four rows in a narrow width direction, and the second soldering portions in the two inner rows are closer to each other in the width direction, so that the connector is likely to incline or topple sideways, thus resulting in a poor soldering effect between the connector and the circuit board or failure of a subsequent reflow soldering process.

Therefore, a heretofore unaddressed need to design a novel connector exists in the art to address the aforementioned deficiencies and inadequacies.

SUMMARY

An objective of the present invention is to provide a connector, which can be stably placed on a circuit board and prevented from inclining or toppling sideways.

To achieve the foregoing objective, certain embodiments of the present invention adopts the following technical solutions.

A connector, configured to be mounted on a circuit board, includes: an insulating body having a bottom surface facing the circuit board; and a plurality of first terminals and a plurality of second terminals, each of the first terminals having a first fixing portion fixed to the insulating body and a first soldering portion bending and extending from the first fixing portion and exposed out of the bottom surface of the insulating body, each of the second terminals having a second fixing portion fixed to the insulating body and a second soldering portion bending and extending from the second fixing portion and exposed out of the bottom surface of the insulating body, and the first soldering portion and the second soldering portion being soldered to the circuit board in a surface mounting manner respectively, wherein the first soldering portions of the first terminals and the second soldering portions of the second terminals are arranged in four rows in a transverse direction, the first soldering portions are distributed in two outer rows, the second soldering portions are distributed in two inner rows, a bottom surface of each of the first soldering portions has a lowest point, the lowest points of the first soldering portions in the two outer rows define a plane, and the second soldering portions are located above the plane.

In certain embodiments, the first soldering portions and the second soldering portions are provided to be inclined to the plane.

In certain embodiments, the first soldering portions in the two outer rows extend away from each other, and the second soldering portions in the two inner rows extend toward each other.

In certain embodiments, the first soldering portion and the second soldering portion adjacent in the transverse direction are located on a same inclined plane.

In certain embodiments, the insulating body has two outer wall surfaces provided opposite to each other in the transverse direction, each of the two outer wall surfaces is concavely provided with a notch, the notches penetrate downward through the bottom surface of the insulating body, and the lowest points and the notches are correspondingly arranged vertically.

In certain embodiments, an upper surface of the circuit board is provided with a plurality of soft solders having an equal thickness and correspondingly conductively connected with the first soldering portions and the second soldering portions, and before the connector is soldered to the circuit board, a bottom surface of each of the second soldering portions has a highest point, and a height difference between the highest point and the lowest point is smaller than the thickness of the soft solders.

In certain embodiments, the height difference between the highest point and the lowest point is smaller than or equal to 0.1 mm.

In certain embodiments, an upper surface of the circuit board is provided with a plurality of first soft solders and a plurality of second soft solders, the first soft solders are conductively connected with the first soldering portions, the second soft solders are conductively connected with the second soldering portions, and a thickness of the second soft solders is greater than a thickness of the first soft solders.

In certain embodiments, when the connector is mounted on the circuit board, the first soldering portions elastically abut the circuit board.

In certain embodiments, the insulating body has a plurality of overpressure protruding blocks formed by protruding downward from the bottom surface thereof, and each of the first soldering portions is at least partially lower than a bottom surface of each of the overpressure protruding blocks.

In certain embodiments, the insulating body has a slot extending along a longitudinal direction perpendicular to the transverse direction; a row of the first soldering portions and a row of the second soldering portions are distributed on two opposite sides of the slot respectively; the first terminals and the second terminals are arranged on the two opposite sides of the slot respectively; and each of the first terminals has a first contact portion provided at an upper end of the first fixing portion, each of the second terminals has a second contact portion provided at an upper end of the second fixing portion, and the first contact portion and the second contact portion protrude into the slot.

In certain embodiments, the first soldering portion extends downward obliquely from a lower end of the first fixing portion toward a direction away from the slot, and the second soldering portion extends downward obliquely from a lower end of the second fixing portion toward the slot.

In certain embodiments, the first terminals and the second terminals on a same side of the slot are staggered in the longitudinal direction.

In certain embodiments, a first gap is provided between the first contact portions on the two opposite sides of the slot in the transverse direction, a second gap is provided between the second soldering portions on the two opposite sides of the slot in the transverse direction, and the first gap is smaller than the second gap.

In certain embodiments, the first fixing portions and the second fixing portions on a same side of the slot are arranged in a row along the longitudinal direction.

In certain embodiments, the circuit board is provided with a plurality of first conductive pads correspondingly and electrically connected to the first soldering portions, each of the first conductive pads has an outer boundary line and an inner boundary line provided to be closer to the slot than the outer boundary line in the transverse direction, and an inner side surface of the corresponding first fixing portion facing the slot is closer to the slot than the inner boundary line.

In certain embodiments, the insulating body has a base and a mounting portion provided on at least one end of the base, the slot is provided on the base and configured for inserting an electronic card, the mounting portion is provided with an accommodating groove for accommodating an ejector, the ejector is provided with a latch portion configured to latch the electronic card and an ejecting portion configured to release the electronic card, the mounting portion has a stopping portion located at an upper end thereof and configured to limit the ejector from excessively rotating toward the slot, and a width of the stopping portion in the transverse direction is smaller than a width of the base in the transverse direction.

In certain embodiments, two buckling portions are provided on two opposite sides of the stopping portion; the ejector is concavely provided with an opening from one side surface thereof; the ejector is provided with two fastening portions on two opposite sides of the opening, and the fastening portions are hidden in the opening; and when the ejector latches the electronic card, the stopping portion is partially accommodated in the opening, and each of the fastening portions is buckled to the corresponding buckling portions.

Compared with the related art, in certain embodiments of the present invention, the plane is defined by the lowest points of the first soldering portions in the two outer rows, and the second soldering portions in the two inner rows are located above the plane, so that when the connector is placed on the circuit board, the first soldering portions abut the circuit board first, and the lowest points of the first soldering portions in the two outer rows function as supporting points when the connector is positioned on the circuit board, thus ensuring the connector to be stably placed on the circuit board and unlikely to incline or topple sideways, thereby ensuring the connector to be better soldered to the circuit board during subsequent reflow soldering.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
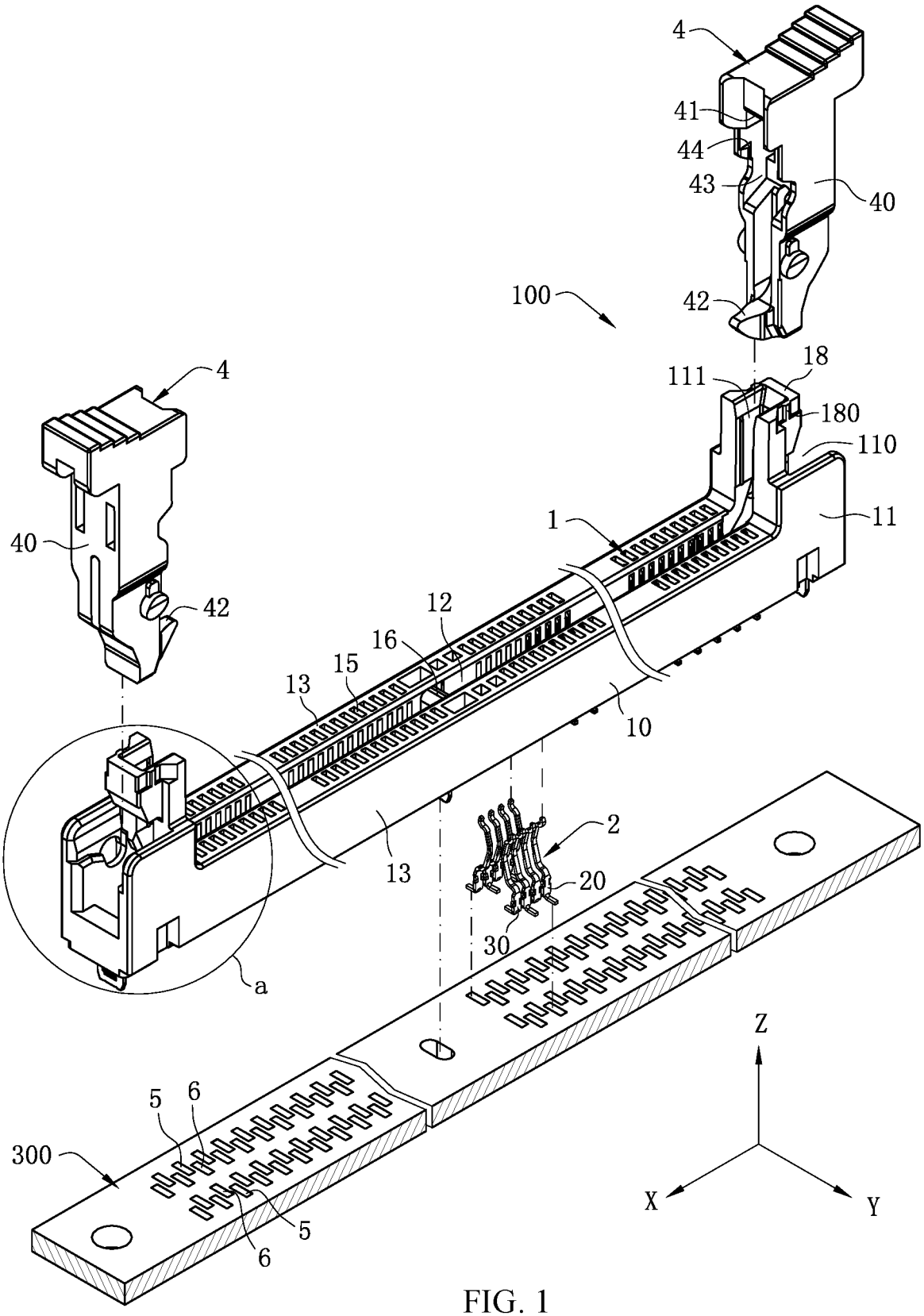
FIG. 1 is a perspective exploded view of a connector and a circuit board according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-12. In accordance with the purposes of this invention, as embodied and broadly described herein, this invention, in one aspect, relates to a connector.

Referring to FIG. 1 to FIG. 9, which show a connector 100 according to a first embodiment of the present invention. The connector 100 is configured to electrically connect an electronic card 200 and a circuit board 300. The connector 100 is mounted downward on the circuit board 300. The connector 100 includes an insulating body 1, multiple terminals 2 arranged on the insulating body 1, and two ejectors 4 pivoted to the insulating body 1. A longitudinal direction X, a transverse direction Y and a vertical direction Z are defined for the connector 100, and the directions are perpendicular to one another.

Figure 2:
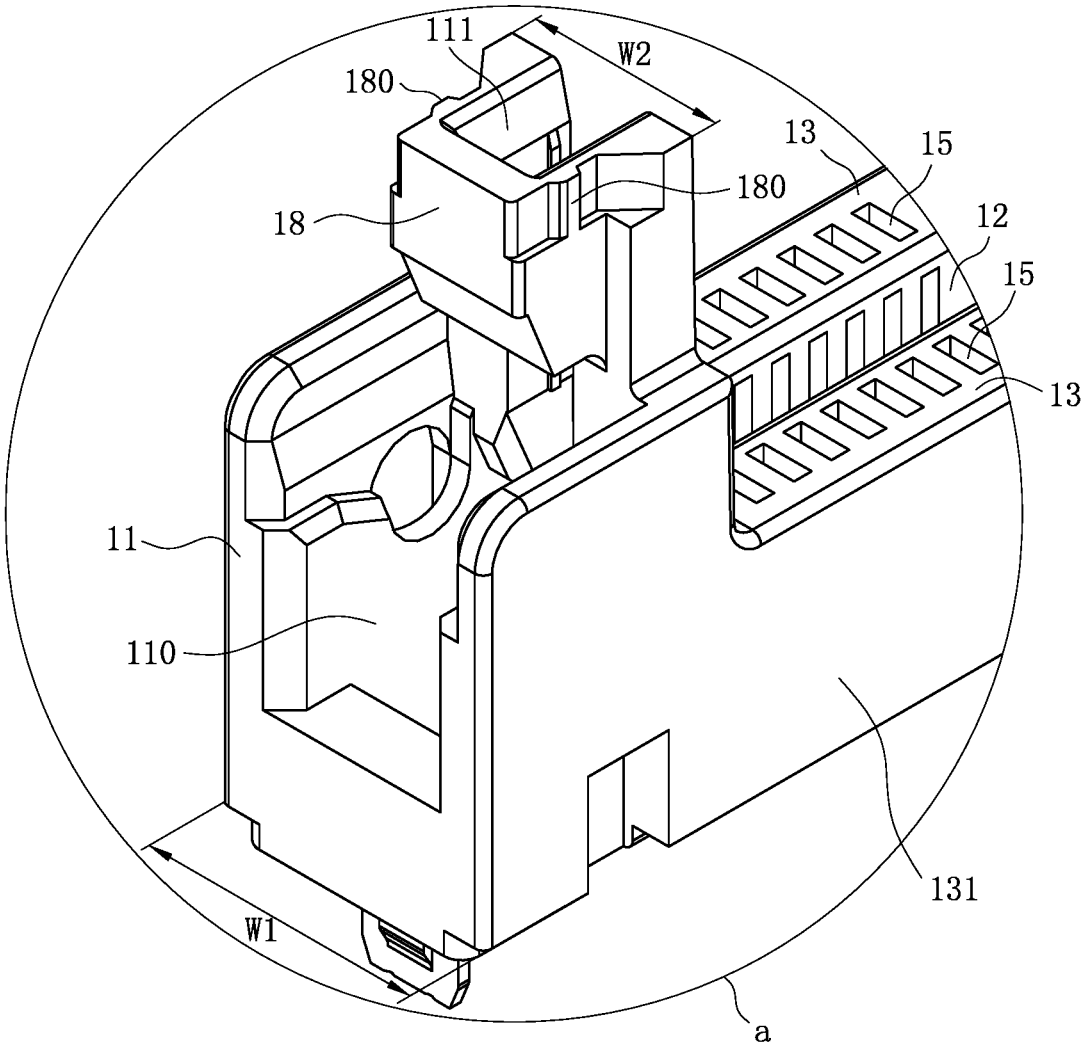
FIG. 2 is an enlarged view of a part a in FIG. 1.
Figure 3:
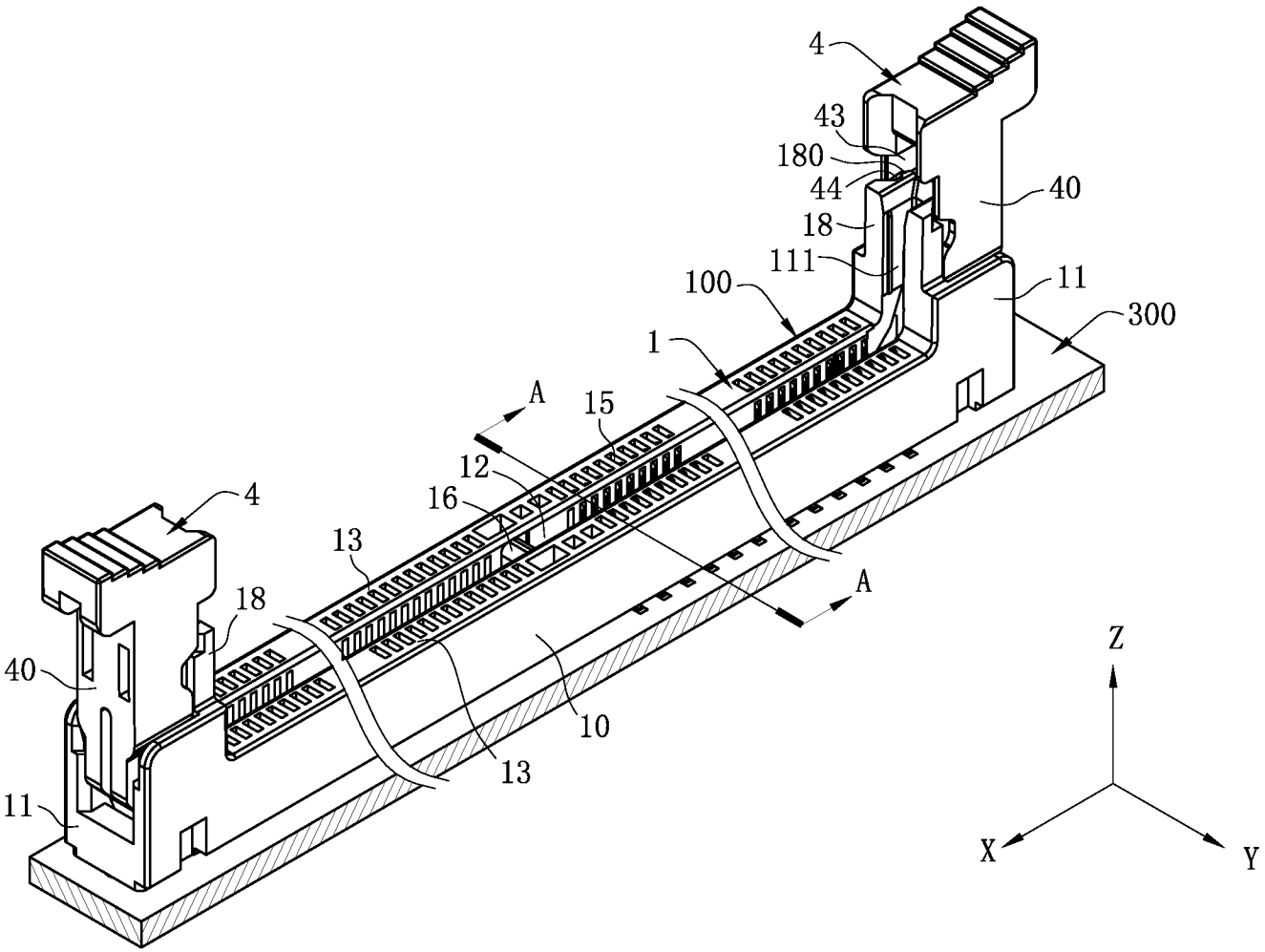
FIG. 3 is a perspective assembled view of FIG. 1.
Figure 6:
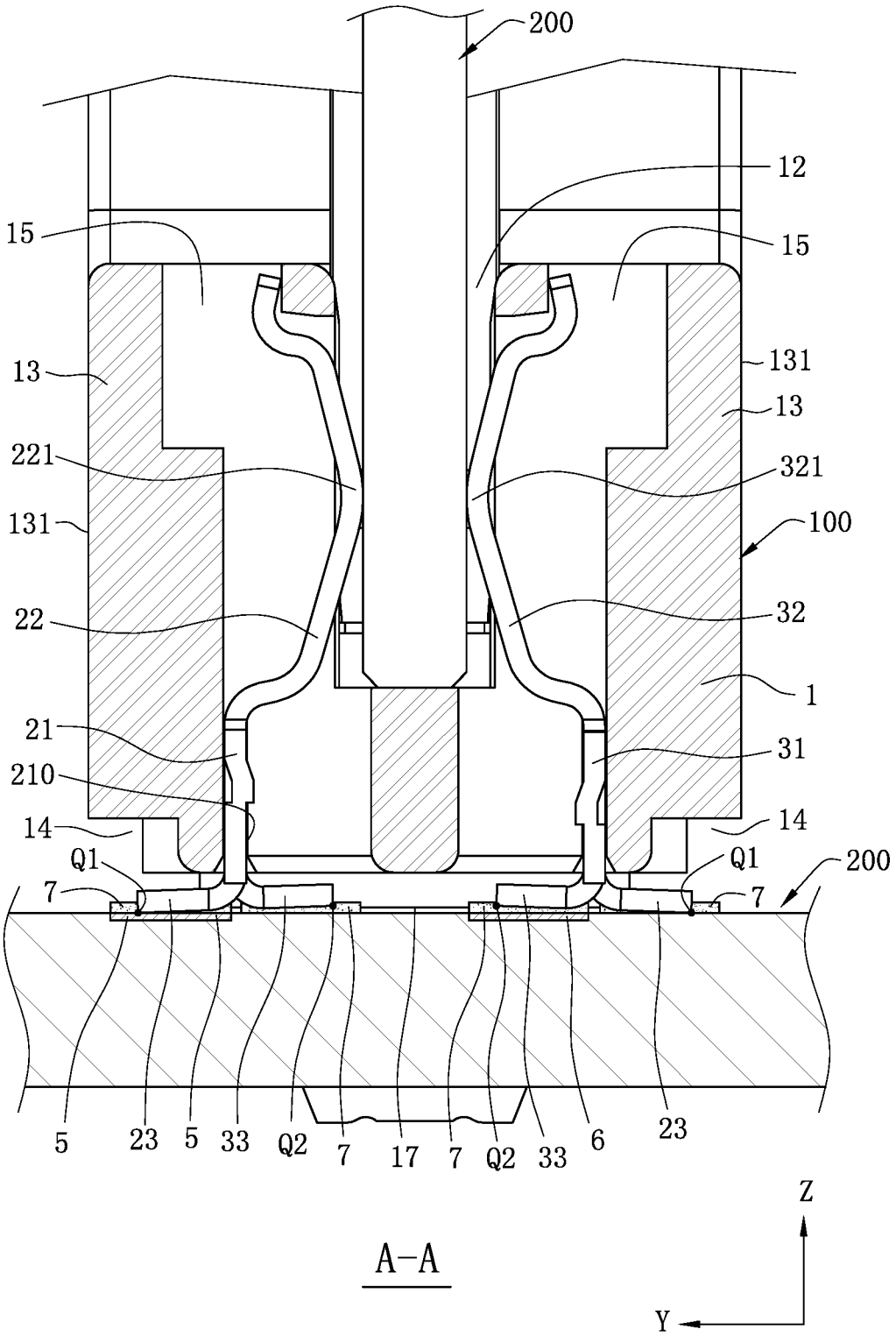
FIG. 6 is a sectional view of FIG. 3 along an A-A line.

Referring to FIG. 1, FIG. 2 and FIG. 6, a bottom surface of the insulating body 1 faces the circuit board 300. The insulating body 1 has a base 10 and two mounting portions 11 arranged at two opposite ends of the base 10. The base 10 has a first width W1 in the transverse direction Y. The base 10 has a slot 12 which is formed by being concavely provided downward from a top surface thereof, and configured for inserting the electronic card 200. The slot 12 extends along the longitudinal direction X on the base 10. The base 10 has two side walls 13 located on two sides of the slot 12, and each side wall 13 has an outer wall surface 131 arranged at one side away from the slot 12 in the transverse direction Y. The insulating body 1 has a notch 14 concavely provided on each of the outer wall surfaces 131, and each of the notches 14 penetrates downward through the bottom surface of the insulating body 1. In the present embodiment, each of the notches 14 extends along the longitudinal direction X on the whole insulating body 1, and each of the notches 14 is distributed on the base 10 and the mounting portions 11. Each side wall 13 is provided with multiple terminal grooves 15. The terminal grooves 15 penetrate through the base 10 vertically, and the terminal grooves 15 are communicated with the slot 12 in the transverse direction Y, and spaced from the corresponding notch 14 without communication thereto. The base 10 is provided with a fool-proof portion 16 that protrudes upward from a slot bottom of the slot 12 and is configured to prevent from false insertion of the electronic card 200. The base 10 has multiple overpressure protruding blocks 17 protruding downward from the bottom surface thereof. The overpressure protruding blocks 17 are configured to abut the circuit board 300, and the overpressure protruding blocks 17 are mainly distributed at two ends of the base 10 and a position corresponding to the fool-proof portion 16 (referring to FIG. 4).

Referring to FIG. 1 and FIG. 2, each mounting portion 11 is provided with a accommodating groove 110, and the two mounting portions 11 are provided with two guide grooves 111 on the sides facing each other. The guide grooves 111 extend vertically and are communicated with the slot 12 in the longitudinal direction X, and the guide grooves 111 are configured to guide the electronic card 200 to be inserted into the slot 12. Each mounting portion 11 has a stopping portion 18 that is located at an upper end thereof and configured to limit the corresponding ejector 4 from excessively rotating toward the slot 12. A portion of each guide groove 111 is formed on the corresponding stopping portion 18. Two buckling portions 180 are provided on two opposite sides of each stopping portion 18, and the two buckling portions 180 are located on two opposite sides of the corresponding guide groove 111. Each of the stopping portions 18 has a second width W2 in the transverse direction Y, and the second width W2 is smaller than the first width W1. Thus, when the connectors 100 are arranged on the circuit board 300 in the transverse direction Y side by side, a heat dissipation channel exists between the adjacent stopping blocks 18, thereby facilitating heat dissipation of the connectors 100.

Referring to FIG. 1 and FIG. 6, the terminals 2 are correspondingly accommodated in the terminal grooves 15. The terminals 2 include multiple first terminals 20 and multiple second terminals 30. The first terminals 20 and the second terminals 30 are distributed on two opposite sides of the slot 12 respectively, and the first terminals 20 and the second terminals 30 on each side of the slot 12 are staggered in the longitudinal direction X. On the two sides of the slot 12, one of the terminals oppositely arranged is the first terminal 20, and the other is the second terminal 30.

Figure 5:
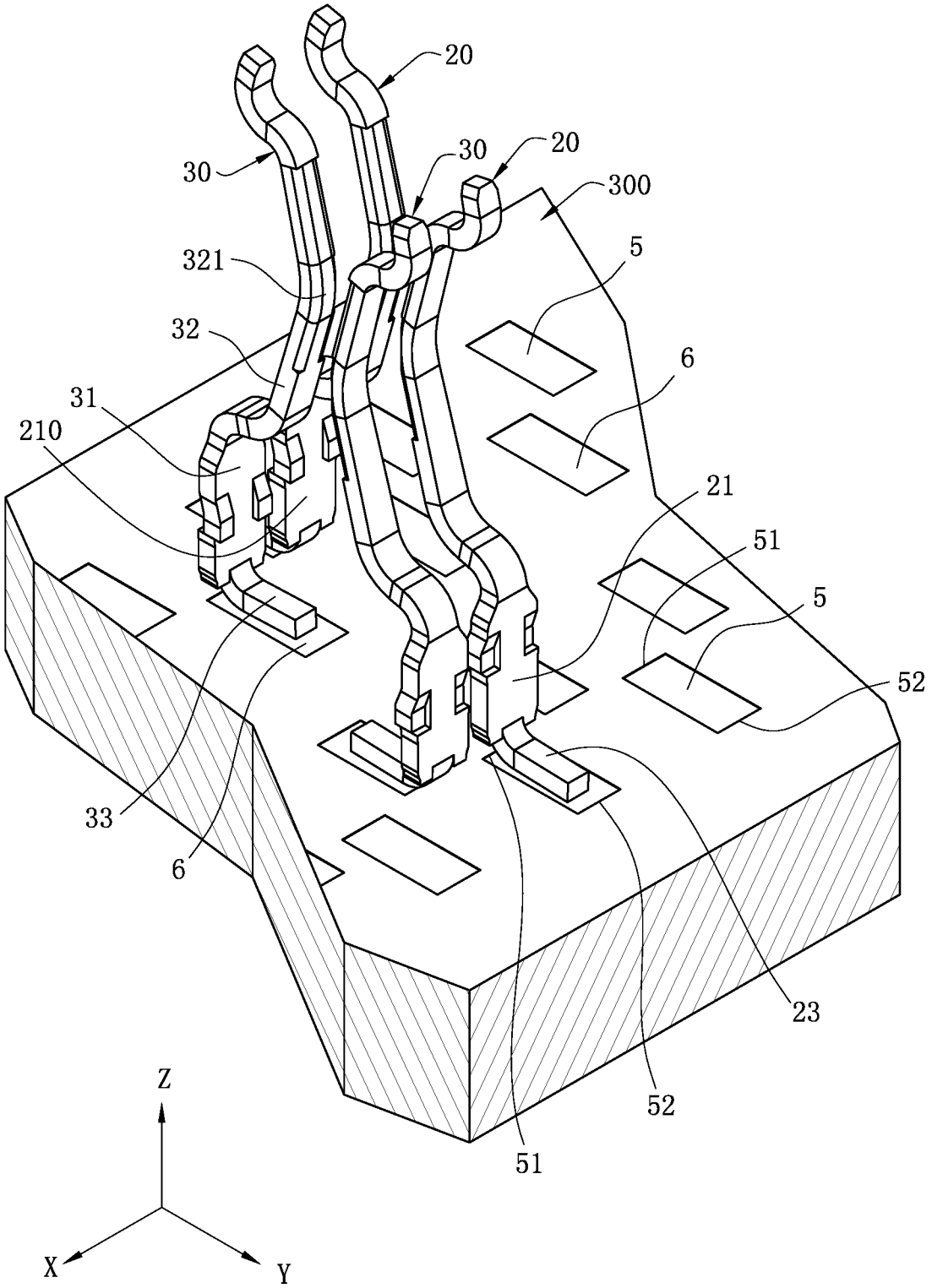
FIG. 5 is a local perspective view of a first terminal and a second terminal placed on the circuit board on two sides of a slot in FIG. 3.

Referring to FIG. 5 and FIG. 6, each first terminal 20 has a first fixing portion 21, a first elastic portion 22 extending upward from an upper end of the first fixing portion 21, and a first soldering portion 23 bending and extending from a lower end of the first fixing portion 21. The first fixing portion 21 is fixed to the corresponding terminal groove 15. The first elastic portion 22 has a first contact portion 221 that protrudes into the slot 12 and is configured to be elastically connected to the electronic card 200. The first soldering portion 23 is exposed out of the bottom surface of the base 10, and the first soldering portion 23 is soldered to the circuit board 300 in a surface mounting manner. The first soldering portion 23 extends downward obliquely from the lower end of the first fixing portion 21 to a direction away from the slot 12. A bottom surface of the first soldering portion 23 has a lowest point Q1, and the lowest point Q1 and the notch 14 on the same side of the slot 12 are correspondingly arranged vertically. The first soldering portion 23 is at least partially lower than a bottom surface of the overpressure protruding block 17. That is, the lowest point Q1 is lower than the bottom surface of the overpressure protruding block 17.

Referring to FIG. 5 and FIG. 6, each second terminal 30 has a second fixing portion 31, a second elastic portion 32 extending upward from an upper end of the second fixing portion 31, and a second soldering portion 33 bending and extending from the lower end of the second fixing portion 31. The second fixing portion 31 is fixed to the corresponding terminal groove 15. The second elastic portion 32 has a second contact portion 321 that protrudes into the slot 12 and is configured to be elastically connected to the electronic card 200. The second soldering portion 33 is exposed out of the bottom surface of the base 10, and the second soldering portion 33 is soldered to the circuit board 300 in a surface mounting manner. The second soldering portion 33 extends upward obliquely from the second fixing portion 31 to the slot 12, and the bottom surface of the second soldering portion 33 has a highest point Q2.

Figure 4:
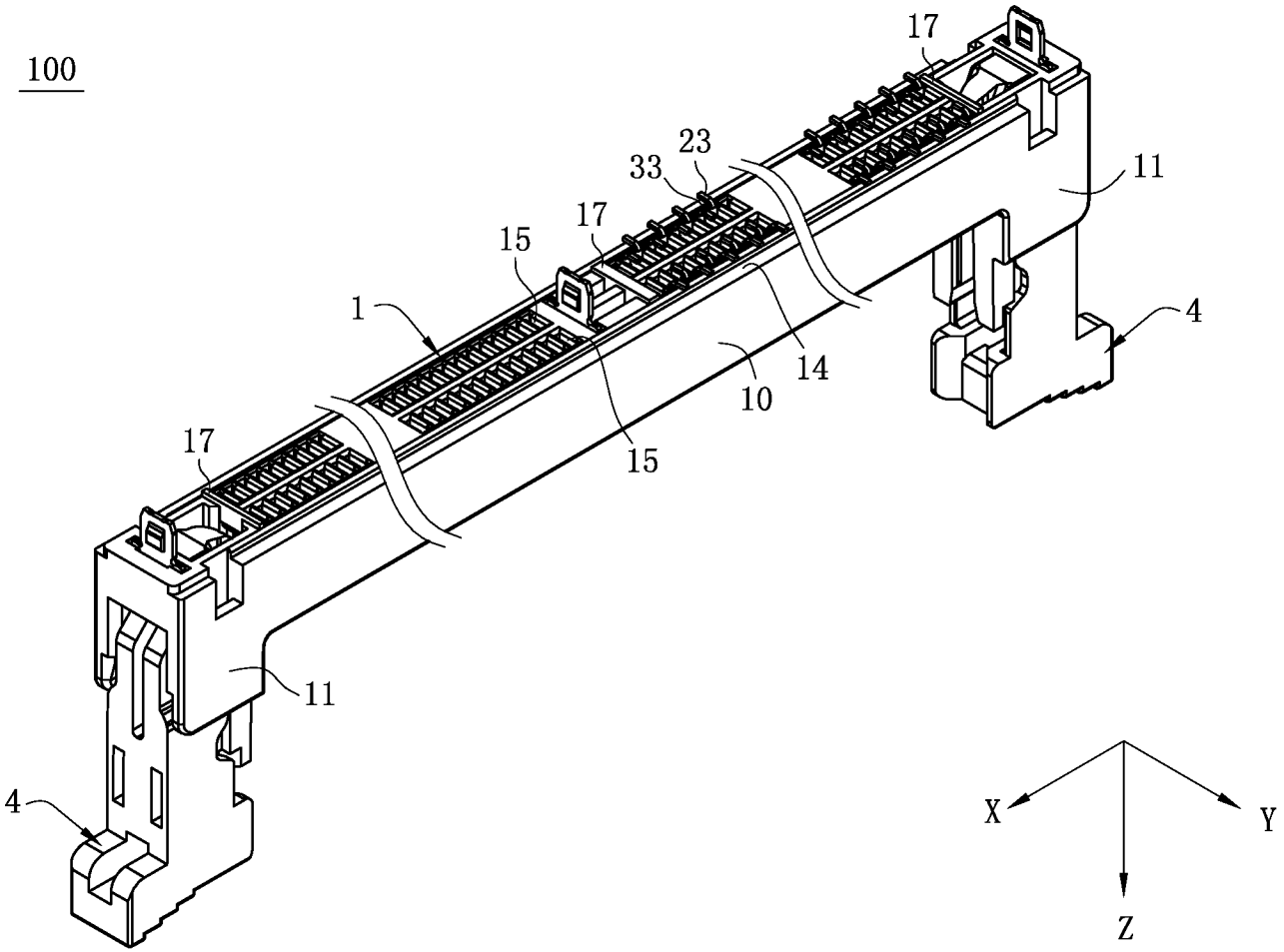
FIG. 4 is a perspective view of the inverted connector in FIG. 3.
Figure 7:
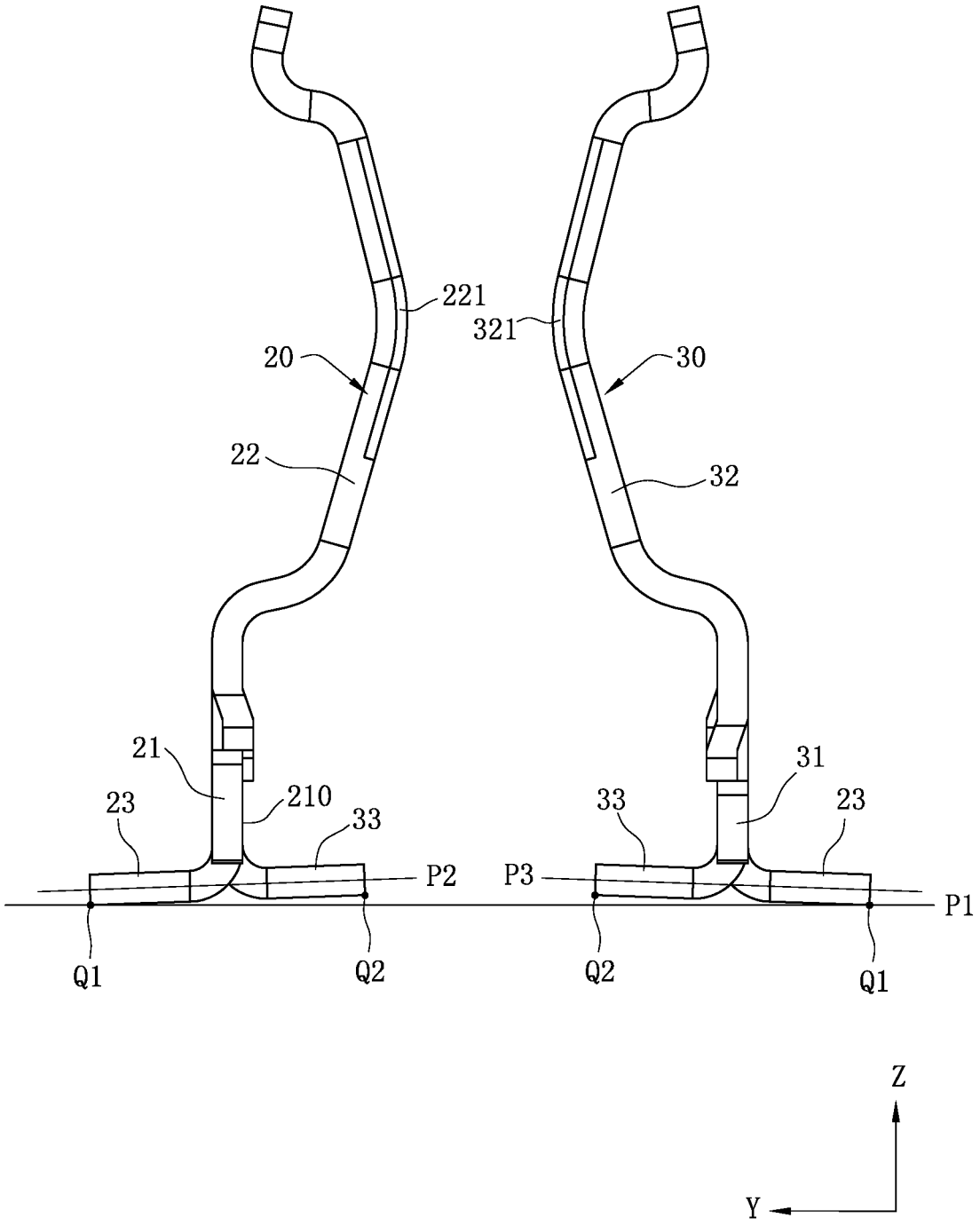
FIG. 7 is a schematic view of the first terminal and the second terminal in FIG. 6.

Referring to FIG. 4, FIG. 6 and FIG. 7, the first soldering portions 23 of the first terminals 20 and the second soldering portions 33 of the second terminals 30 are arranged in the transverse direction Y in four rows. The first soldering portions 23 are distributed in two outer rows, and the second soldering portions 33 are distributed in two inner rows. The first soldering portions 23 in the two outer rows extend away from each other, and the second soldering portions 33 in the two inner rows extend toward each other. A plane P1 is defined by the lowest points Q1 of the first soldering portions 23 in the two outer rows, and the second soldering portions 33 are located above the plane P1. The first fixing portions 21 and the second fixing portions 31 on each side of the slot 12 are arranged in a row along the longitudinal direction X. For the first contact portions 221 and the second contact portions 321 on each side of the slot 12, the lengths thereof protruding into the slot 12 are equal, and the heights thereof are equal. The first soldering portions 23 and the second soldering portions 33 on the same side of the slot 12 are staggered in the longitudinal direction X. In the present embodiment, the first soldering portions 23 and the second soldering portions 33 are provided to be inclined to the plane P1, and the first soldering portions 23 and the second soldering portions 33 on the same side of the slot 12 are located on the same inclined plane. One of the inclined planes is defined as a first inclined plane P2, and the other is defined as a second inclined plane P3.

Referring to FIG. 1, FIG. 2 and FIG. 6, the ejectors 4 are accommodated in the corresponding accommodating grooves 110. Each ejector 4 has a main body portion 40, a latch portion 41 arranged at an upper end of the main body portion 40, and an ejecting portion 42 arranged at a lower end of the main body portion 40. The latch portion 41 and the card withdrawal portion 42 extend from the main body portion 40 to the slot 12 respectively. The latch portion 41 is configured to latch the electronic card 200, and the ejecting portion 42 is configured to release the electronic card 200. The main body portion 40 is concavely provided with an opening 43 from one side surface thereof facing the slot 12. The ejector 4 is provided with two fastening portions 44 respectively on two opposite sides of the opening 43, and the fastening portions 44 are hidden in the opening 43. When the ejector 4 latches the electronic card 200, the stopping portion 18 is partially accommodated in the opening 43, and each of the fastening portions 44 is buckled to the corresponding buckling portions 180.

Figure 9:
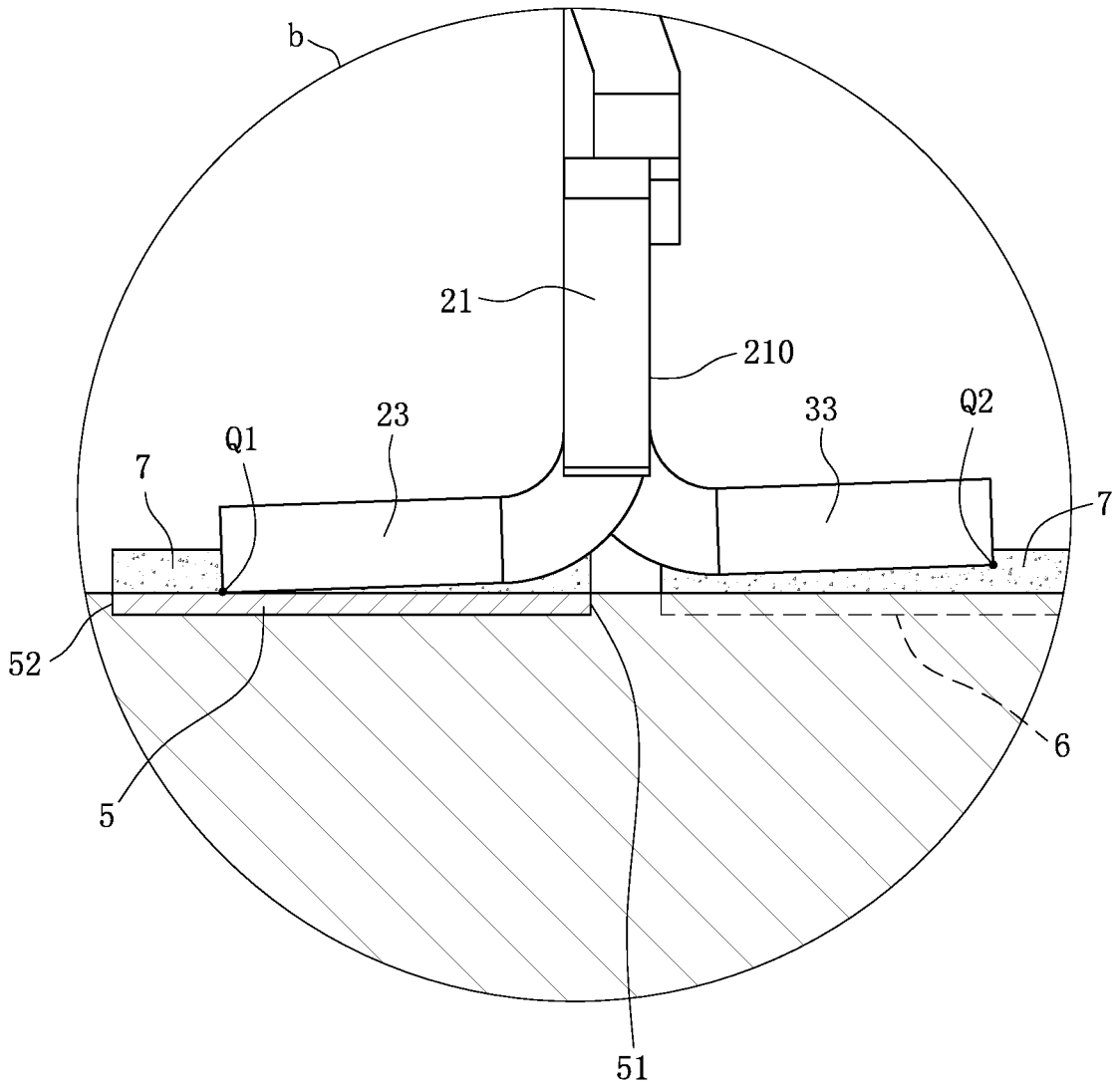
FIG. 9 is an enlarged view of a part b in FIG. 8.

Referring to FIG. 1, FIG. 5 and FIG. 9, an upper surface of the circuit board 300 is provided with multiple first conductive pads 5 and multiple second conductive pads 6. The first conductive pads 5 are correspondingly conductively connected with the first soldering portions 23, and the second conductive pads 6 are correspondingly conductively connected with the second soldering portions 33. Therefore, the first conductive pads 5 and the second conductive pads 6 are arranged on the circuit board 300 in four rows. Each first conductive pad 5 has an outer boundary line 52 and an inner boundary line 51 provided to be closer to the slot 12 than the outer boundary line 52 in the transverse direction Y, and an inner side surface 210 of the corresponding first fixing portion 21 facing the slot 12 is closer to the slot 12 than the inner boundary line 51. Thus, an invalid signal transmission path generated by the first conductive pad 5 relative to the first fixing portion 21 can be shortened, and signal losses can be reduced.

Figure 8:
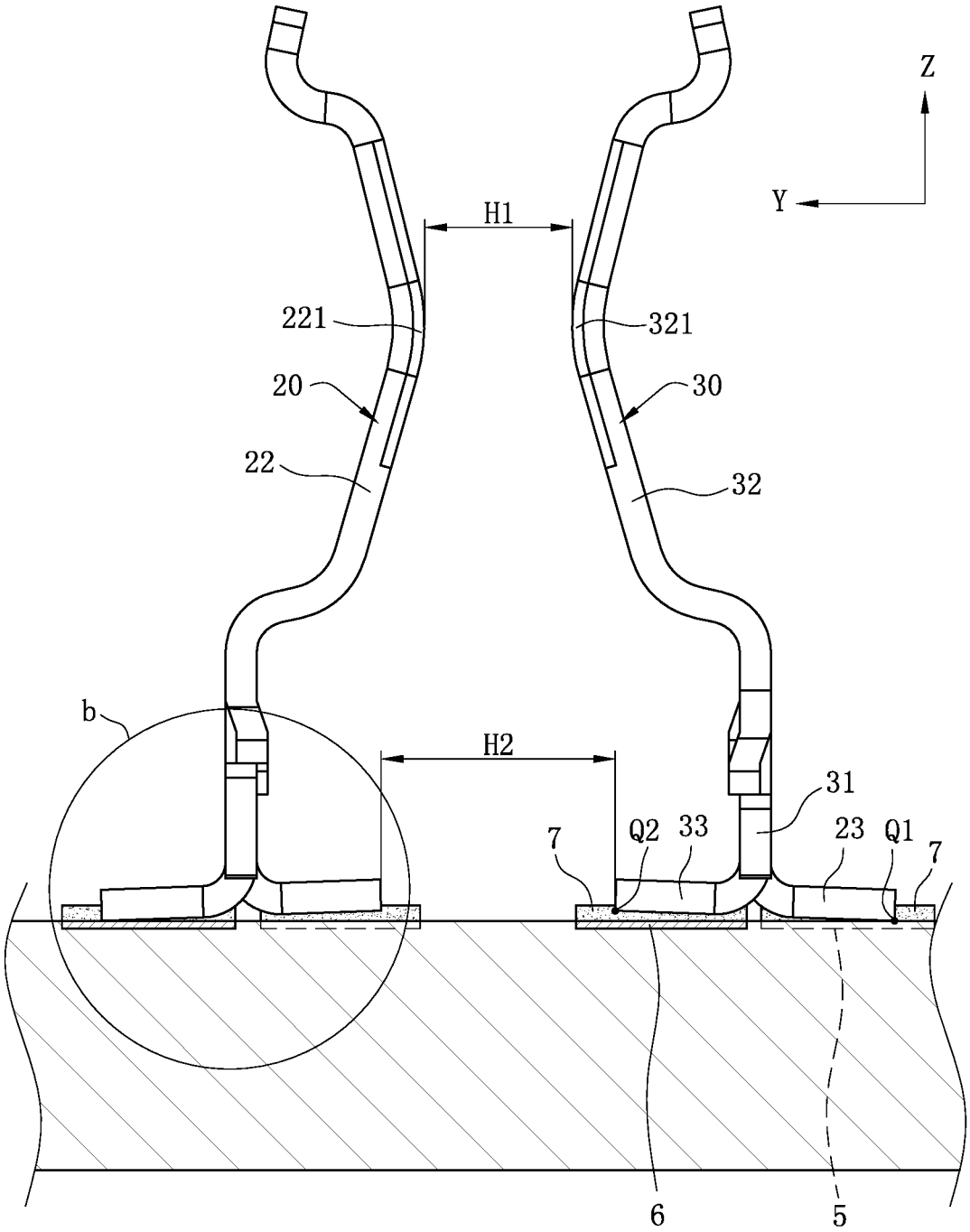
FIG. 8 is a schematic view of the first terminal, the second terminal and the circuit board in FIG. 6.

Referring to FIG. 6, FIG. 8 and FIG. 9, before the connector 100 is mounted on the circuit board 300, it is necessary to provide a soft solder 7 on each of the first conductive pads 5 and each of the second conductive pads 6 respectively. In the present embodiment, the soft solder 7 on the first conductive pad 5 and the soft solder 7 on the second conductive pad 6 are equal in thickness, so that the counts of coating the soft solders 7 on the first soldering portion 23 and the second soldering portion 33 can be reduced.

Referring to FIG. 6, FIG. 8 and FIG. 9, when the connector 100 is mounted on the circuit board 300, the first soldering portion 23 is inserted into the corresponding soft solder 7 first and abuts the first conductive pad 5, and the first soldering portions 23 in the two outer rows function as supporting points when the connector is positioned on the circuit board 300, thus ensuring the connector 100 to be stably placed on the circuit board 300 and unlikely to incline or topple sideways, thereby ensuring the connector 100 to be better soldered to the circuit board 300 during subsequent reflow soldering. The first soldering portion 23 is at least partially lower than the bottom surface of the overpressure protruding block 17, so that when the connector 100 is mounted on the circuit board 300 due to an overlarge external force, by abutting the circuit board 300 through the bottom surface of the overpressure protruding block 17, overpressure deformation of the first soldering portion 23 can be avoided.

Referring to FIG. 6, FIG. 8 and FIG. 9, in order to make both the first soldering portions 23 and the second soldering portions 33 inserted into the corresponding soft solders 7 when the connector 100 is mounted on the circuit board 300, namely in order to ensure that both the first soldering portions 23 and the second soldering portions 33 can be well soldered to the circuit board 300 respectively during reflow soldering of the connector 100, a height difference between the highest point Q2 of the second soldering portion 33 and the lowest point Q1 of the first soldering portion 23 is smaller than the thickness of the soft solder 7. In the present embodiment, the height difference between the highest point Q2 and the lowest point Q1 is smaller than or equal to 0.1 mm.

Figure 10:
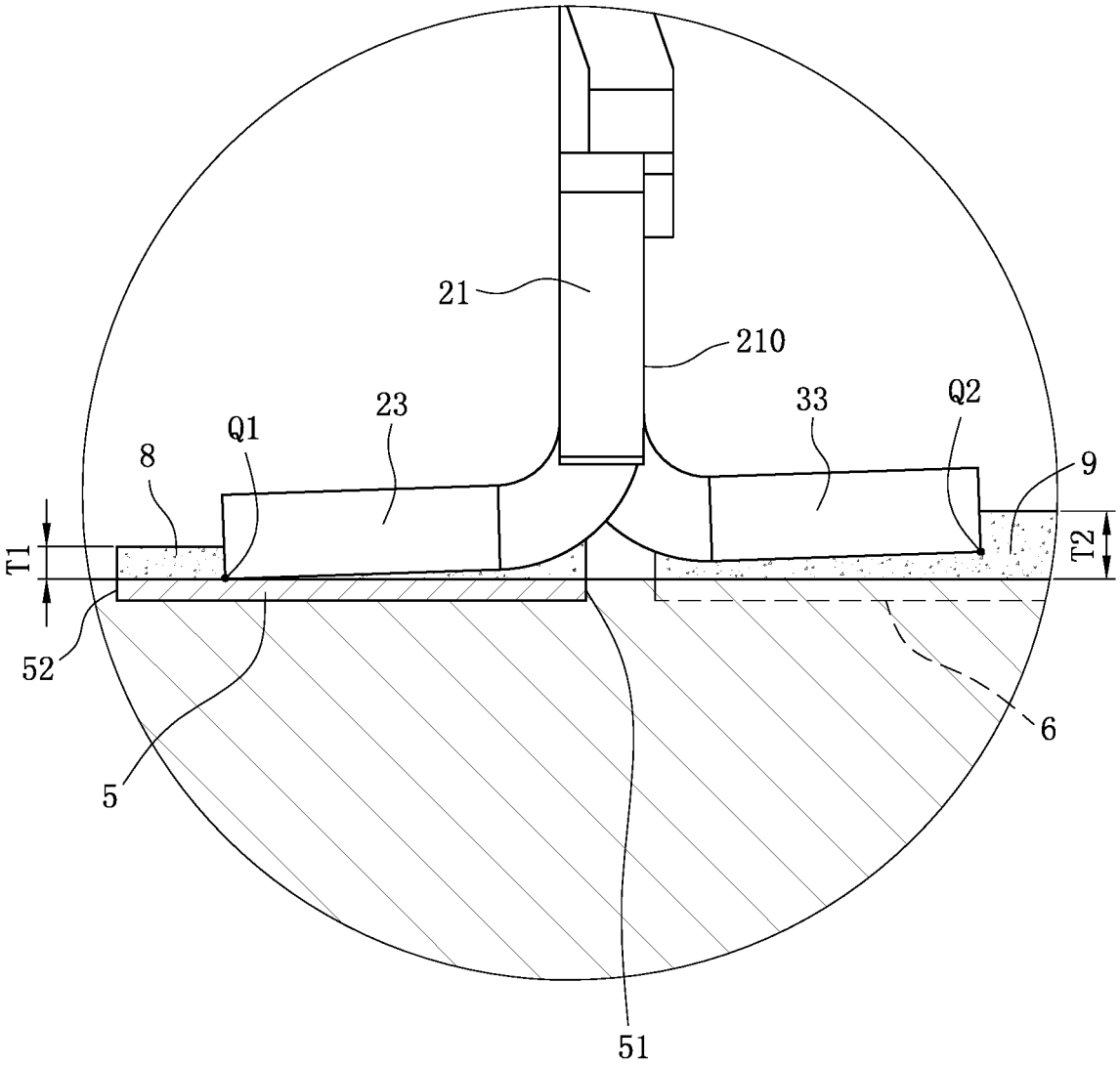
FIG. 10 is a schematic view of different-thickness soft solders conducted with a first soldering portion and a second soldering portion in FIG. 8.

Referring to FIG. 6, FIG. 8 and FIG. 10, the soft solders 7 conductively connected with the first soldering portions 23 and the second soldering portions 33 may be different in thickness. The soft solder 7 conductively connected with the first soldering portion 23 is defined as a first soft solder 8, and a thickness of the first soft solder 8 is defined as a first thickness T1. The soft solder 7 conductively connected with the second soldering portion 33 is defined as a second soft solder 9, and a thickness of the second soft solder 9 is defined as a second thickness T2. The second thickness T2 is greater than the first thickness T1. The second soldering portions 33 are located above the plane P1, so when the lowest point Q1 of the first soldering portion 23 is inserted into the first soft solder 8 and abuts the first conductive pad 5, a gap exists between the second soldering portions 33 and the second conductive pad 6. As the second thickness T2 is greater than the first thickness T1, the second soldering portions 33 can be in good contact with the second soft solders 9, thereby ensuring good soldering.

Figure 11:
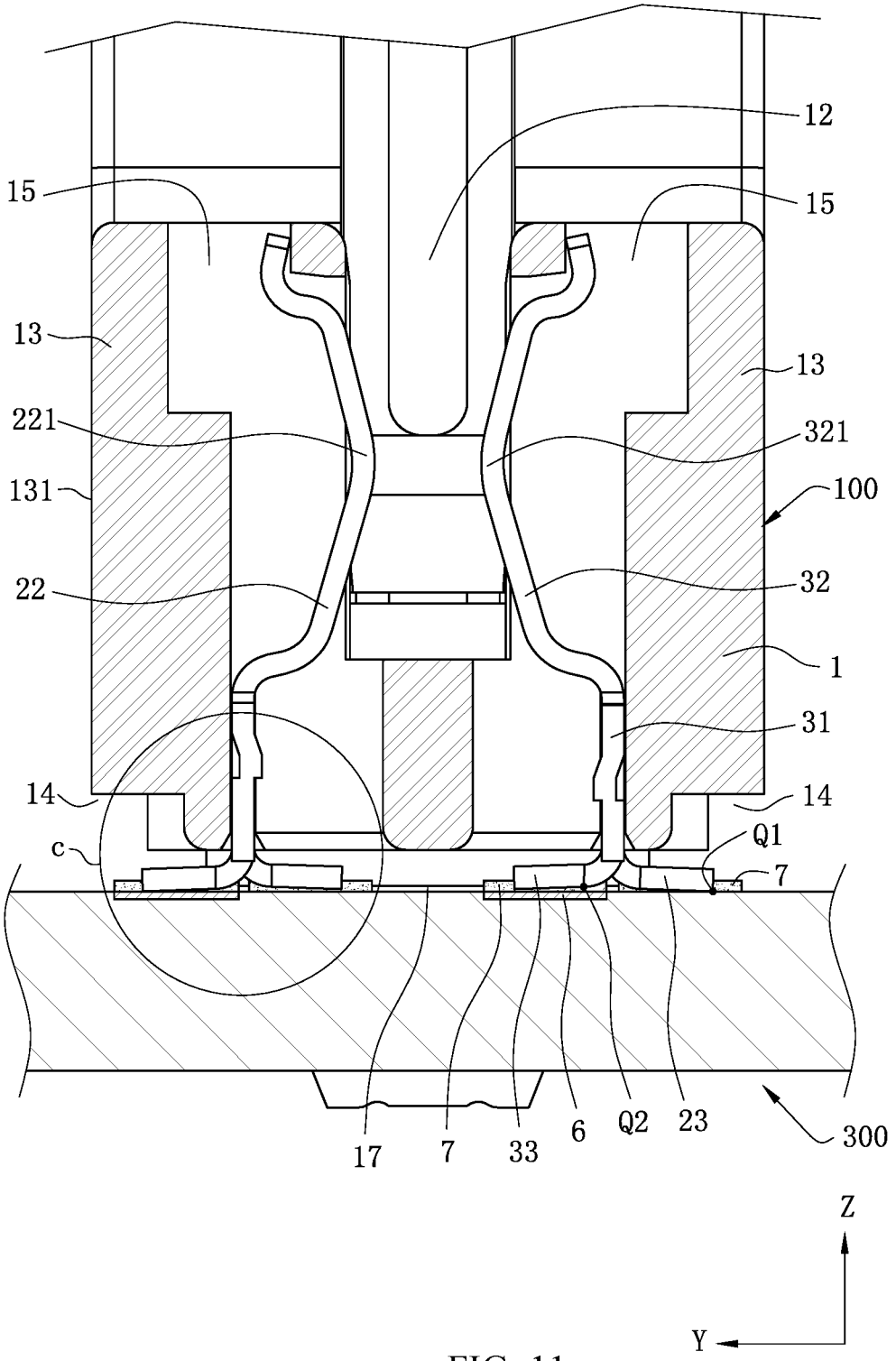
FIG. 11 is a structural view of a connector according to a second embodiment of the present invention.
Figure 12:
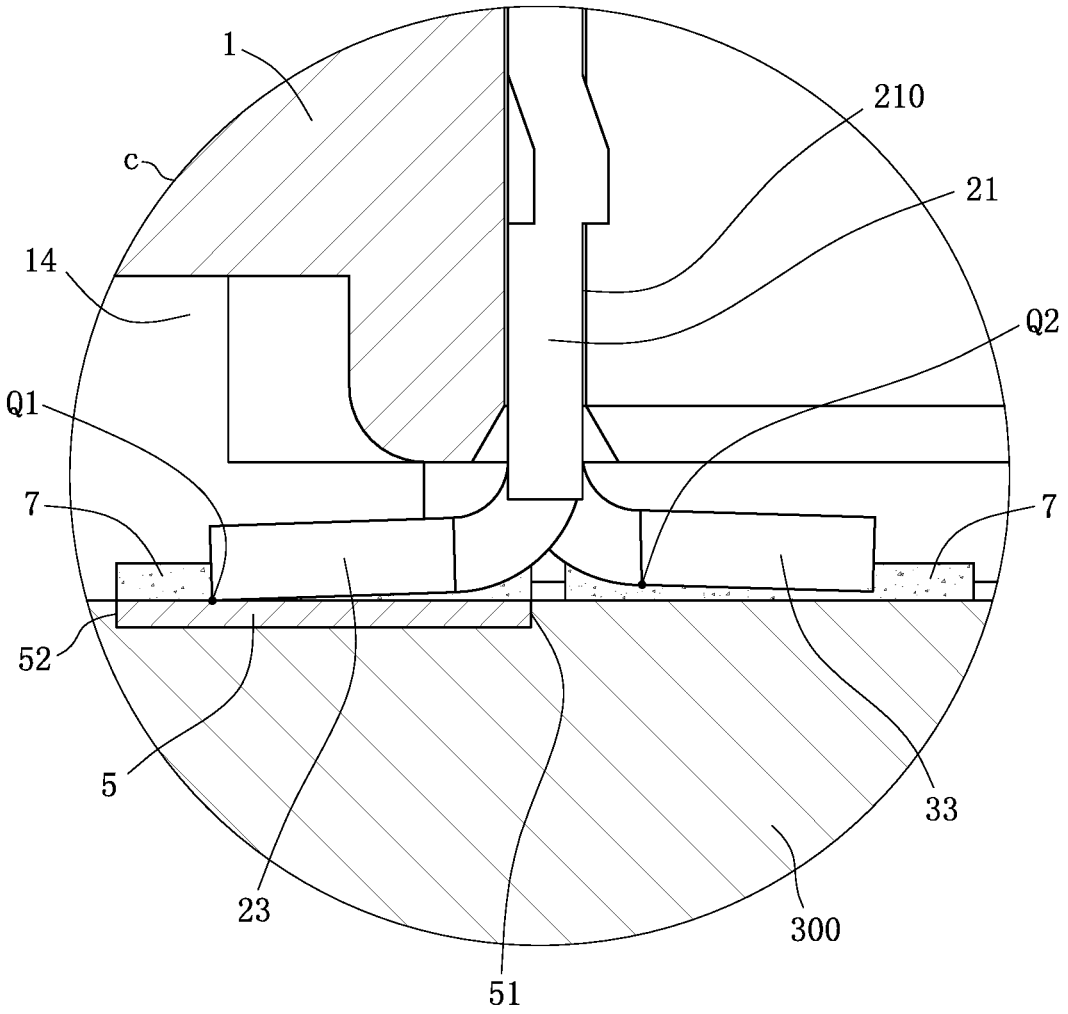
FIG. 12 is an enlarged view of a part c in FIG. 11.

Referring to FIG. 11 and FIG. 12, which show a connector 100 according to a second embodiment of the present invention. The connector 100 in the present embodiment and the connector 100 in the first embodiment have substantially the same structure, which are not herein elaborated. The difference exists in that: the first soldering portion 23 extends downward obliquely from the lower end of the first fixing portion 21 to a direction away from the slot 12, and the second soldering portion 33 extends downward obliquely from the lower end of the second fixing portion 31 to the slot 12. In other embodiments, the first soldering portion 23 has certain elasticity. Thus, when the connector 100 is mounted on the circuit board 300, the first soldering portion 23 elastically abuts the first conductive pad 5 under the gravity effect of the connector 100, and the first soldering portion 23 moves up under the action of force, so that the height difference between the lowest point Q1 of the first soldering portion 23 and the highest point Q2 of the second soldering portion 33 can be reduced. Alternatively, the first soldering portion 23 and the second soldering portion 33 may also be horizontally arranged.

To sum up, the connector according to certain embodiments of the present invention has the following beneficial effects.

1. The first soldering portions 23 and the second soldering portions 33, which are exposed out of the bottom surface of the insulating body 1, are arranged in four rows. The first soldering portions 23 are distributed in two outer rows, and the second soldering portions 33 are distributed in two inner rows. The first soldering portions 23 and the second soldering portions 33 are soldered to the circuit board 300 in a surface mounting manner. A plane P1 is defined by the lowest points Q1 of the first soldering portions 23 in the two outer rows, and the second soldering portions 33 in the two inner rows are located above the plane P1. Thus, when the connector 100 is placed on the circuit board 300, the first soldering portions 23 abut the circuit board 300 first, and the lowest points Q1 of the first soldering portions 23 in the two outer rows function as supporting points when the connector is positioned on the circuit board 300, thus ensuring the connector 100 to be stably placed on the circuit board 300 and unlikely to incline or topple sideways, thereby ensuring the connector 100 to be better soldered to the circuit board 300 during subsequent reflow soldering.

2. The first soldering portions 23 in the two outer rows extend away from each other, and the second soldering portions 33 in the two inner rows extend toward each other. The first terminals 20 and the second terminals 30 on the same side of the slot 12 are staggered in the longitudinal direction X, so that the distance between the adjacent first soldering portions 23 in the same row can be increased, and the distance between the adjacent second soldering portions 33 in the same row can be increased, thereby avoiding short-circuiting during reflow soldering of the connector 100. In addition, on the two sides of the slot 12, one of the terminals oppositely arranged is the first terminal 20, and the other is the second terminal 30. Further, the distance between the second soldering portions 33 in the two inner rows is increased, thereby preventing from short-circuiting and mutual signal interference between the second soldering portions 33 in the two inner rows.

3. The height difference between the highest point Q2 of the second soldering portion 33 and the lowest point Q1 of the first soldering portion 23 is smaller than the thickness of the soft solder 7, so that when the connector 100 is mounted on the circuit board 300, both the first soldering portion 23 and the second soldering portion 33 can be inserted into the soft solders 7, thereby ensuring that both the first soldering portion 23 and the second soldering portion 33 can be well soldered to the circuit board 300 separately during reflow soldering of the connector 100.

4. The first soft solder 8 is arranged on the first conductive pad 5, and the second soft solder 9 is arranged on the second conductive pad 6. The first conductive pad 5 is configured to be electrically connected to the first soldering portion 23, and the second conductive pad 6 is configured to be electrically connected to the second soldering portion 33. The second thickness T2 of the second soft solder 9 is greater than the first thickness T1 of the first soft solder 8, so that the second soldering portion 33 located above the plane P1 can be in good contact with the second soft solder 9, thereby ensuring good soldering between the second soldering portion 33 and the first conductive pad 5 through the second soft solder 9 after reflow soldering of the connector 100.

5. The first gap H1 is provided between the first contact portions 221 on the two opposite sides of the slot 12 in the transverse direction Y. The second gap H2 is provided between the second soldering portions 33 on the two opposite sides of the slot 12 in the transverse direction Y. The first gap H1 is smaller than the second gap H2. Thus, the distance between the second soldering portions 33 in the two inner rows is large, thereby preventing from short-circuiting and mutual signal interference between the second soldering portions 33 in the two inner rows.

6. Each first conductive pad 5 has an outer boundary line 52 and an inner boundary line 51 provided to be closer to the slot 12 than the outer boundary line 52 in the transverse direction Y, and an inner side surface 210 of the corresponding first fixing portion 21 facing the slot 12 is closer to the slot 12 than the inner boundary line 51. Thus, an invalid signal transmission path generated by the first conductive pad 5 relative to the first fixing portion 21 can be shortened, and signal losses can be reduced.

7. The insulating body 1 has the notch 14 concavely formed from the outer wall surface 131, and the lowest point Q1 of the first soldering portion 23 and the corresponding notch 14 are correspondingly arranged vertically. Thus, it is convenient to observe the contact between the first soldering portion 23 and the soft solder 7 or the first soft solder 8, and the heat dissipation of the first soldering portion 23 can be facilitated during operation of the connector 100.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A connector, configured to be mounted on a circuit board, comprising:

an insulating body having a bottom surface facing the circuit board; and a plurality of first terminals and a plurality of second terminals, each of the first terminals having a first fixing portion fixed to the insulating body and a first soldering portion bending and extending from the first fixing portion and exposed out of the bottom surface of the insulating body, each of the second terminals having a second fixing portion fixed to the insulating body and a second soldering portion bending and extending from the second fixing portion and exposed out of the bottom surface of the insulating body, and the first soldering portion and the second soldering portion being soldered to the circuit board in a surface mounting manner respectively, wherein the first soldering portions of the first terminals and the second soldering portions of the second terminals are arranged in four rows in a transverse direction, the first soldering portions are distributed in two outer rows, the second soldering portions are distributed in two inner rows, a bottom surface of each of the first soldering portions has a lowest point, the lowest points of the first soldering portions in the two outer rows define a plane, and the second soldering portions are located above the plane.

2. The connector of claim 1, wherein the first soldering portions and the second soldering portions are provided to be inclined to the plane.

3. The connector of claim 2, wherein the first soldering portions in the two outer rows extend away from each other, and the second soldering portions in the two inner rows extend toward each other.

4. The connector of claim 3, wherein the first soldering portion and the second soldering portion adjacent in the transverse direction are located on a same inclined plane.

5. The connector of claim 2, wherein the insulating body has two outer wall surfaces provided opposite to each other in the transverse direction, each of the two outer wall surfaces is concavely provided with a notch, the notches penetrate downward through the bottom surface of the insulating body, and the lowest points and the notches are correspondingly arranged vertically.

6. The connector of claim 2, wherein an upper surface of the circuit board is provided with a plurality of soft solders having an equal thickness and correspondingly conductively connected with the first soldering portions and the second soldering portions, and before the connector is soldered to the circuit board, a bottom surface of each of the second soldering portions has a highest point, and a height difference between the highest point and the lowest point is smaller than the thickness of the soft solders.

7. The connector of claim 6, wherein the height difference between the highest point and the lowest point is smaller than or equal to 0.1 mm.

8. The connector of claim 1, wherein an upper surface of the circuit board is provided with a plurality of first soft solders and a plurality of second soft solders, the first soft solders are conductively connected with the first soldering portions, the second soft solders are conductively connected with the second soldering portions, and a thickness of the second soft solders is greater than a thickness of the first soft solders.

9. The connector of claim 1, wherein when the connector is mounted on the circuit board, the first soldering portions elastically abut the circuit board.

10. The connector of claim 1, wherein the insulating body has a plurality of overpressure protruding blocks formed by protruding downward from the bottom surface thereof, and each of the first soldering portions is at least partially lower than a bottom surface of each of the overpressure protruding blocks.

11. The connector of claim 1, wherein:

the insulating body has a slot extending along a longitudinal direction perpendicular to the transverse direction;

a row of the first soldering portions and a row of the second soldering portions are distributed on two opposite sides of the slot respectively;

the first terminals and the second terminals are arranged on the two opposite sides of the slot respectively; and each of the first terminals has a first contact portion provided at an upper end of the first fixing portion, each of the second terminals has a second contact portion provided at an upper end of the second fixing portion, and the first contact portion and the second contact portion protrude into the slot.

12. The connector of claim 11, wherein the first soldering portion extends downward obliquely from a lower end of the first fixing portion toward a direction away from the slot, and the second soldering portion extends downward obliquely from a lower end of the second fixing portion toward the slot.

13. The connector of claim 11, wherein the first terminals and the second terminals on a same side of the slot are staggered in the longitudinal direction.

14. The connector of claim 11, wherein a first gap is provided between the first contact portions on the two opposite sides of the slot in the transverse direction, a second gap is provided between the second soldering portions on the two opposite sides of the slot in the transverse direction, and the first gap is smaller than the second gap.

15. The connector of claim 11, wherein the first fixing portions and the second fixing portions on a same side of the slot are arranged in a row along the longitudinal direction.

16. The connector of claim 11, wherein the circuit board is provided with a plurality of first conductive pads correspondingly and electrically connected to the first soldering portions, each of the first conductive pads has an outer boundary line and an inner boundary line provided to be closer to the slot than the outer boundary line in the transverse direction, and an inner side surface of the corresponding first fixing portion facing the slot is closer to the slot than the inner boundary line.

17. The connector of claim 11, wherein the insulating body has a base and a mounting portion provided on at least one end of the base, the slot is provided on the base and configured for inserting an electronic card, the mounting portion is provided with an accommodating groove for accommodating an ejector, the ejector is provided with a latch portion configured to latch the electronic card and an ejecting portion configured to release the electronic card, the mounting portion has a stopping portion located at an upper end thereof and configured to limit the ejector from excessively rotating toward the slot, and a width of the stopping portion in the transverse direction is smaller than a width of the base in the transverse direction.

18. The connector of claim 17, wherein:

two buckling portions are provided on two opposite sides of the stopping portion;

the ejector is concavely provided with an opening from one side surface thereof;

the ejector is provided with two fastening portions on two opposite sides of the opening, and the fastening portions are hidden in the opening; and when the ejector latches the electronic card, the stopping portion is partially accommodated in the opening, and each of the fastening portions is buckled to the corresponding buckling portions.

* * * * *